US011175616B2

(12) United States Patent
Kato

(10) Patent No.: US 11,175,616 B2
(45) Date of Patent: Nov. 16, 2021

(54) IMAGE FORMING APPARATUS

(71) Applicant: Oki Data Corporation, Tokyo (JP)

(72) Inventor: Koji Kato, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/174,492

(22) Filed: Feb. 12, 2021

(65) Prior Publication Data

US 2021/0271196 A1 Sep. 2, 2021

(30) Foreign Application Priority Data

Feb. 27, 2020 (JP) ..... JP2020-031699

(51) Int. Cl.
*G03G 15/00* (2006.01)
*G03G 21/16* (2006.01)

(52) U.S. Cl.
CPC ..... *G03G 15/5004* (2013.01); *G03G 15/80* (2013.01); *G03G 21/1633* (2013.01)

(58) Field of Classification Search
CPC ..... G03G 15/5004; G03G 15/80; G03G 21/1633; G03G 21/1638; H04N 1/00896
See application file for complete search history.

(56) References Cited

U.S. PATENT DOCUMENTS

2007/0242960 A1* 10/2007 Kobayashi ..... G03G 21/1652 399/13
2014/0022605 A1* 1/2014 Shimizu ..... H04N 1/00037 358/449

FOREIGN PATENT DOCUMENTS

JP 2006-159740 A 6/2006

* cited by examiner

*Primary Examiner* — Hoang X Ngo
(74) *Attorney, Agent, or Firm* — Rabin & Berdo, P.C.

(57) ABSTRACT

An image forming apparatus includes: a cover; a power supply that supplies a drive system supply voltage and a control system supply voltage in an operating mode, and that supplies the control system supply voltage without supplying the drive system supply voltage in a power saving mode; an interlock switch including a first terminal that receives the drive system supply voltage, a second terminal that receives the control system supply voltage, and a third terminal connected to a line for supplying the drive system supply voltage to an image forming portion, the interlock switch connecting the first and third terminals when the cover is closed, and connecting the second and third terminals when the cover is open; and a detector that, when the control system supply voltage is applied to the line in the power saving mode, stores information indicating that the cover has been opened.

9 Claims, 8 Drawing Sheets

180
DRIVE SYSTEM LOAD
181
ID MOTOR
HIGH-VOLTAGE POWER SUPPLY
182
141
140
INTERLOCK SWITCH DETECTION CIRCUIT
127
PRINTER CONTROLLER
OUT
IN
POWER SAVING CONTROLLER
124a
124
IN
VCC
170
INTERRUPTION CIRCUIT
171
172
174
173
0V
SECOND DETECTION CIRCUIT
5V
152
5V
FIRST DETECTION CIRCUIT
151
0V
0V
161
162
163
160
150
C
L2
130
131
132
133
NO
NC
134
L1
L3
24V
5V

FIG. 8

| COVER | 24 V POWER SUPPLY | COVER OPEN DETECTION SIGNAL | SECOND DETECTION CIRCUIT | FIRST DETECTION CIRCUIT |
|---|---|---|---|---|
| OPEN | ON | LOW | LOW | LOW |
| OPEN | OFF | HIGH | LOW | LOW |
| OPEN | OFF | LOW | LOW | LOW |
| CLOSED | ON | LOW | HIGH | LOW |
| CLOSED | OFF | HIGH | LOW | HIGH |
| CLOSED | OFF | LOW | LOW | LOW |

IMAGE FORMING APPARATUS

BACKGROUND OF THE INVENTION

1. Field of the Invention

The present invention relates to an image forming apparatus.

2. Description of the Related Art

Conventionally, there is an image forming apparatus employing an interlock system that, upon detecting that a cover has been opened, stops a motor or a high-voltage circuit.

When a cover of an image forming apparatus has been opened, a user may have accessed an interior of the image forming apparatus and performed replacement of a part or other operations. Thus, even in a power saving mode or in a power-off state, there is a need to detect whether the cover has been opened. Here, the power saving mode is, for example, a mode in which, although the image forming apparatus is turned on, the image forming apparatus consumes less power than in an operating mode in which images are formed by the image forming apparatus. The power-off state is, for example, a state in which the image forming apparatus is turned off.

For example, Japanese Patent Application Publication No. 2006-159740 describes an image forming apparatus that includes an interlock switch connected to a line connected to a drive system power line for supplying a drive system supply voltage and a control system power line for supplying a control system supply voltage and detects opening and closing of a cover by monitoring a detection voltage that changes depending on whether the cover is open or closed. In this image forming apparatus, when the cover is opened, the interlock switch is turned off to interrupt the drive system supply voltage.

However, in the conventional image forming apparatus, since the drive system power line and the control system power line for supplying the control system supply voltage are always connected, current leakage from a control system power supply to a drive system power supply circuit or a drive system load occurs in both an operating mode and a power saving mode. This wastes power.

SUMMARY OF THE INVENTION

One or more aspects of the present invention are intended to perceive that a cover has been opened, with low power consumption.

According to a first aspect of the present invention, there is provided an image forming apparatus including: a housing; an image forming portion configured to perform an operation of conveying a medium and forming a developer image on the medium, at least a part of the image forming portion being housed in the housing; a cover attached to the housing and configured to be opened to access the part of the image forming portion; a power supply configured to supply a drive system supply voltage used by the image forming portion and a control system supply voltage lower than the drive system supply voltage in an operating mode in which the image forming portion can perform the operation, and configured to supply the control system supply voltage without supplying the drive system supply voltage in a power saving mode in which less power is consumed than in the operating mode; a supply power line configured to receive the control system supply voltage from the power supply; an interlock switch including a first terminal connected to a first drive system power line to which the drive system supply voltage is applied by the power supply, a second terminal configured to receive the control system supply voltage via the supply power line, and a third terminal connected to a second drive system power line for supplying the drive system supply voltage to the image forming portion, the interlock switch being configured to connect the first terminal and the third terminal when the cover is closed, and connect the second terminal and the third terminal when the cover is open; and a cover open detector connected to the second drive system power line and configured, when the control system supply voltage is applied to the second drive system power line in the power saving mode, to store information indicating that the cover has been opened.

According to a second aspect of the present invention, there is provided an image forming apparatus including: a housing; an image forming portion configured to perform an operation of conveying a medium and forming a developer image on the medium, at least a part of the image forming portion being housed in the housing; a cover attached to the housing and configured to be opened to access the part of the image forming portion; a power supply configured to supply a drive system supply voltage used by the image forming portion and a control system supply voltage lower than the drive system supply voltage in an operating mode in which the image forming portion can perform the operation, and configured to supply the control system supply voltage without supplying the drive system supply voltage in a power saving mode in which less power is consumed than in the operating mode; a supply power line configured to receive the control system supply voltage from the power supply; an interlock switch including a first terminal connected to a first drive system power line to which the drive system supply voltage is applied by the power supply, a second terminal configured to receive the control system supply voltage via the supply power line, and a third terminal connected to a second drive system power line for supplying the drive system supply voltage to the image forming portion, the interlock switch being configured to connect the first terminal and the third terminal when the cover is closed, and connect the second terminal and the third terminal when the cover is open; a drive system supply voltage detector connected to the second drive system power line and configured to detect whether the drive system supply voltage is applied to the second drive system power line; and an interrupter connected to the second drive system power line and configured, when the drive system supply voltage detector detects that the drive system supply voltage is not applied to the second drive system power line, to disconnect the image forming portion from the second drive system power line.

With one or more aspects of the present invention, it is possible to perceive that a cover has been opened, with low power consumption.

BRIEF DESCRIPTION OF THE DRAWINGS

In the attached drawings:

FIG. 8 is a truth table of the interlock switch detection circuit in the second embodiment.

DETAILED DESCRIPTION OF THE INVENTION

First Embodiment

Figure 1:
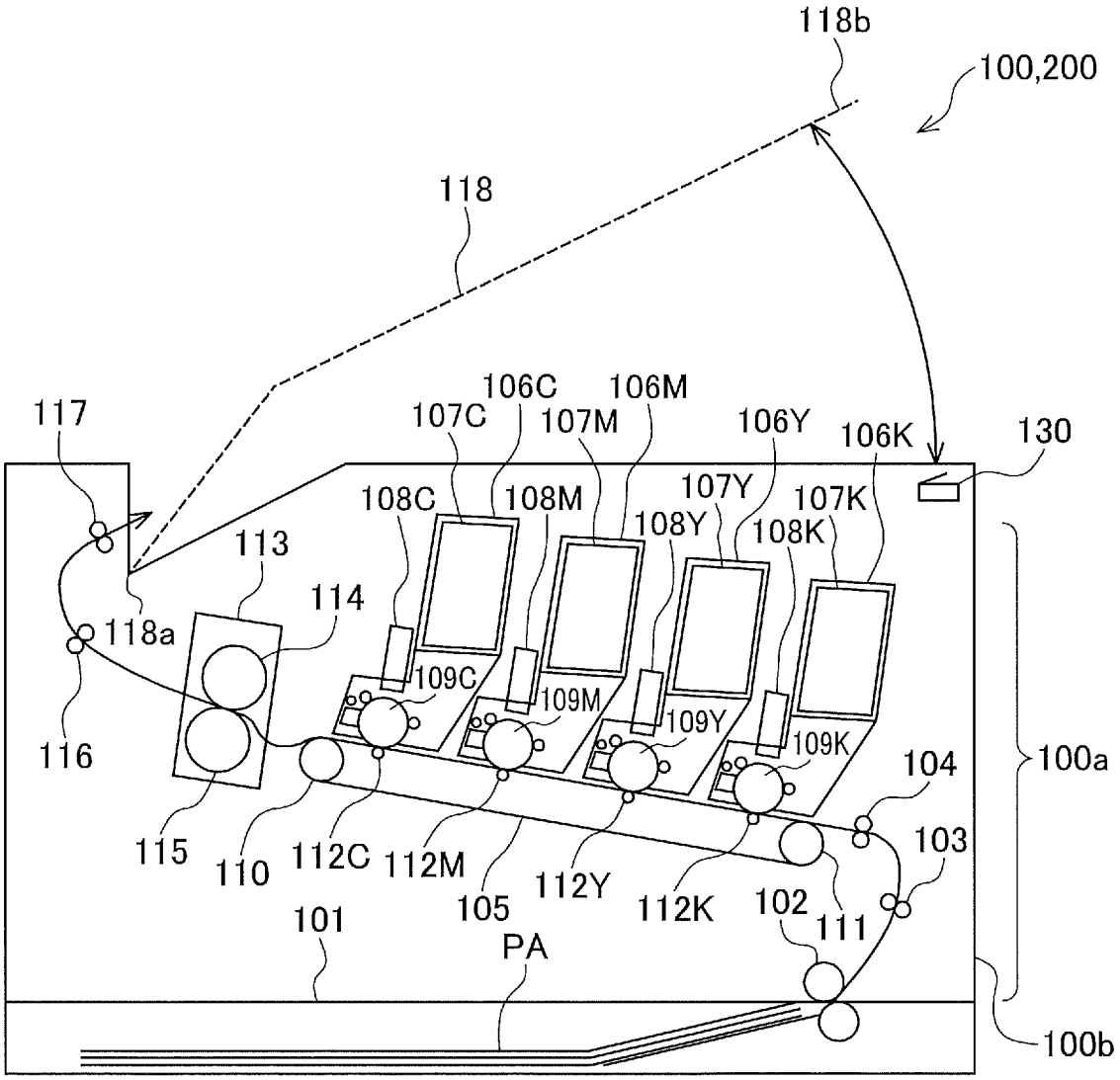
FIG. 1 is a sectional view schematically illustrating an overall configuration of an image forming apparatus according to a first embodiment.

FIG. 1 is a sectional view schematically illustrating an overall configuration of an image forming apparatus 100 according to a first embodiment.

In FIG. 1, the image forming apparatus 100 includes a paper feed cassette 101, an image forming portion (or print engine) 100*a* that performs an operation of picking up a paper sheet PA as a medium from the paper feed cassette 101, conveying the paper sheet PA, forming a toner image, which is a developer image, with toner, which is developer, transferring the toner image onto the paper sheet PA, and fixing the transferred toner image to the paper sheet PA, a housing 100*b* that houses at least a part of the image forming portion 100*a*, a cover 118 attached to the housing 100*b*, and an interlock switch 130.

The image forming portion 100*a* includes a hopping roller 102, a first pair of registration rollers 103, a second pair of registration rollers 104, a conveyance belt 105, image drum (ID) units 106K, 106Y, 106M, and 106C, which are image forming units, light emitting diode (LED) heads 108K, 108Y, 108M, and 108C, which are exposure units, a belt driving roller 110, a driven roller 111, transfer rollers 112K, 112Y, 112M, and 112C, a fixing unit 113, a first pair of discharging rollers 116, and a second pair of discharging rollers 117.

At least a part of the image forming portion 100*a* is housed in the housing 100*b*.

The paper feed cassette 101 is a medium container that contains paper sheets PA.

The hopping roller 102 feeds one of the paper sheets PA from the paper feed cassette 101.

The first pair of registration rollers 103 and the second pair of registration rollers 104 correct skew of the fed paper sheet PA and feed it to the conveyance belt 105 at a predetermined time.

The ID units 106K, 106Y, 106M, and 106C are disposed above the conveyance belt 105 in this order from the upstream side in a direction in which the paper sheet PA is conveyed.

The ID unit 106K forms a black toner image, the ID unit 106Y forms a yellow toner image, the ID unit 106M forms a magenta toner image, and the ID unit 106C forms a cyan toner image.

In FIG. 1, the capital letters K, Y, M, and C added to the ends of the reference numerals indicate black, yellow, magenta, and cyan, respectively.

The ID units 106K, 106Y, 106M, and 106C include removable toner cartridges 107K, 107Y, 107M, and 107C, respectively. Each of the toner cartridges 107K, 107Y, 107M, and 107C contains toner of the corresponding color. The ID units 106K, 106Y, 106M, and 106C also include photosensitive drums 109K, 109Y, 109M, and 109C, respectively, and charge surfaces of them.

The LED heads 108K, 108Y, 108M, and 108C respectively expose the charged surfaces of the photosensitive drums 109K, 109Y, 109M, and 109C to form electrostatic latent images. The electrostatic latent images are developed with the toners by the ID units 106K, 106Y, 106M, and 106C, so that toner images are formed.

The conveyance belt 105 is wound around the belt driving roller 110 and driven roller 111, and rotates with rotation of the belt driving roller 110.

The transfer rollers 112K, 112Y, 112M, and 112C are disposed to face the respective photosensitive drums 109K, 109Y, 109M, and 109C with the conveyance belt 105 therebetween.

The conveyance belt 105 conveys the paper sheet PA to positions where the ID units 106K, 106Y, 106M, and 106C are disposed, and the transfer rollers 112K, 112Y, 112M, and 112C transfer the toner images formed on the photosensitive drums 109K, 109Y, 109M, and 109C onto the paper sheet PA.

The fixing unit 113 heats and presses the paper sheet PA to fuse and fix the toner images transferred on the paper sheet PA.

The fixing unit 113 includes a fixing portion 114 that performs the heating and a backup portion 115 that performs the pressing. The fixing portion 114 is, for example, a fixing belt unit including a planar heater. The fixing portion 114 is heated to a temperature at which the toner images can be fixed, by power supplied to the planar heater. The backup portion 115 is a fixing roller that is pressed against the fixing portion 114 by an urging means (not illustrated), such as a spring.

The paper sheet PA with the toner images fixed thereon is discharged outside the image forming apparatus 100 by the first pair of discharging rollers 116 and second pair of discharging rollers 117.

The cover 118 is attached to the housing 100*b*. One end 118*a* of the cover 118 is rotatably attached to the housing 100*b*, and a user can access at least the part of the image forming portion 100*a* housed in the housing 100*b* by raising another end 118*b* of the cover 118 upward away from the housing 100*b*.

The image forming apparatus 100 is also provided with the interlock switch 130 for detecting that the cover 118 is open.

Figure 2:
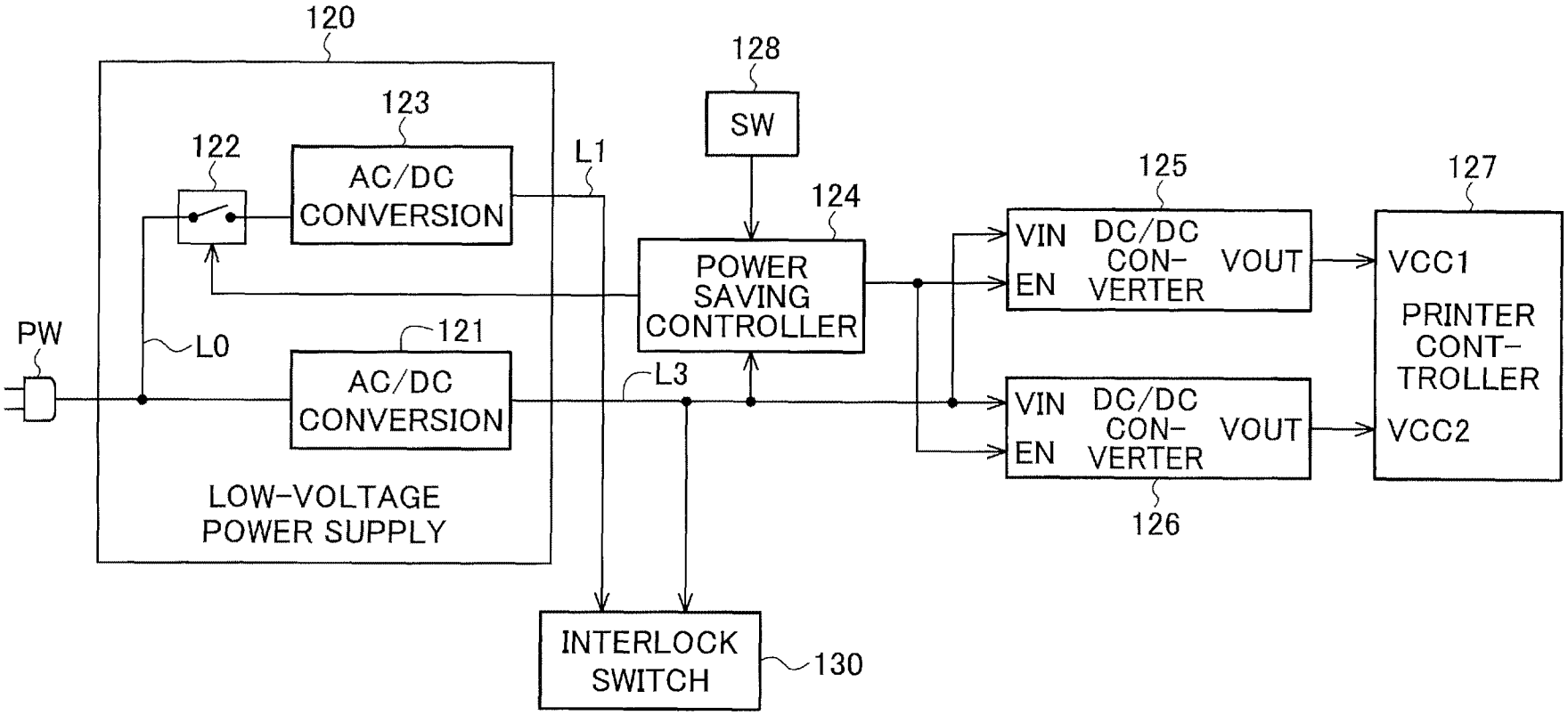
FIG. 2 is a block diagram schematically illustrating a configuration of a power supply system of the image forming apparatus according to the first embodiment.

FIG. 2 is a block diagram schematically illustrating a configuration of a power supply system of the image forming apparatus 100 according to the first embodiment.

A low-voltage power supply 120 is connected to a commercial power supply via a plug PW, and receives alternating-current power from the commercial power supply.

The low-voltage power supply 120 is a power supply that is a switching power supply and includes a sub power supply circuit 121, a relay circuit 122, and a main power supply circuit 123.

The sub power supply circuit 121 is formed by an alternating-current (AC)/direct-current (DC) conversion circuit that outputs a control system supply voltage of 5V.

The relay circuit 122 is disposed in a supply line L0 that supplies AC power from the commercial power supply to the main power supply circuit 123, and allows and interrupts the supply of AC power to the main power supply circuit 123 in accordance with commands from a power saving controller 124 to be described later.

The main power supply circuit 123 is formed by an AC/DC conversion circuit that outputs a drive system supply voltage of 24 V. The drive system supply voltage (24 V) is input to the interlock switch 130 via a first drive system power line L1.

The interlock switch 130 is connected to an interlock switch detection circuit 140 to be described later.

The control system supply voltage (5 V) is input to the power saving controller 124, a DC/DC converter 125, a DC/DC converter 126, and the interlock switch 130 via a control system power line L3 that is a supply power line for supplying the control system supply voltage (5 V).

The DC/DC converter 125 outputs a voltage of 3.3 V as an I/O voltage of a printer controller 127.

The DC/DC converter 126 outputs a voltage of 1.2 V as a core voltage of a central processing unit (CPU) of the printer controller 127.

Each of the DC/DC converters 125 and 126 outputs the output voltage to the printer controller 127 in accordance with whether an enable signal from the power saving controller 124 is on or off.

A power switch 128 is connected to the power saving controller 124.

The power switch 128 is a tactile switch that is pressed by a user when the image forming apparatus 100 is turned on or off.

When the image forming apparatus 100 is turned on by a user, the image forming apparatus 100 enters a power-on state. When the image forming apparatus 100 is turned off by a user, the image forming apparatus 100 enters a power-off state.

In the power-on state, the image forming apparatus 100 has an operating mode (or first mode) in which the image forming portion 100*a* can perform an operation of forming an image, and a power saving mode (or second mode) in which the image forming portion 100*a* does not perform the operation of forming an image and consumes less power than in the operating mode. The operating mode is a mode in which the drive system supply voltage is supplied to the image forming portion 100*a*, and the power saving mode is a mode in which the drive system supply voltage is not supplied to the image forming portion 100*a*.

When the image forming apparatus 100 is turned off by a user, the power saving controller 124 turns off the enable signal to place the image forming apparatus 100 in the power-off state. In the power-off state, the power saving controller 124 performs only monitoring of cover opening and monitoring of the power switch 128, which is a trigger for turning on, and the power consumption of the image forming apparatus 100 is minimum. In the power-off state, the printer controller 127 is inactive, and the supply of the voltages from the DC/DC converters 125 and 126 to the printer controller 127 is stopped. Thus, a second detection circuit 160 to be described later is also inactive.

In the power saving mode, the power saving controller 124 turns off the relay circuit 122 to stop the output of the drive system supply voltage (24 V). The power saving mode is a mode in which power supply to a drive system is shut off, the image forming apparatus 100 is waiting for input of image forming data (or print data), and the power consumption is low. In the power saving mode, since the power saving controller 124 keeps the enable signal on, the voltages are supplied from the DC/DC converters 125 and 126 to the printer controller 127, and the printer controller 127 is active.

As above, in the operating mode, the low-voltage power supply 120 supplies the drive system supply voltage (24 V) used by the image forming portion 100*a* and the control system supply voltage (5 V) lower than the drive system supply voltage (24 V). Also, in the power saving mode, the low-voltage power supply 120 supplies the control system supply voltage (5 V) without supplying the drive system supply voltage (24 V).

Figure 3:
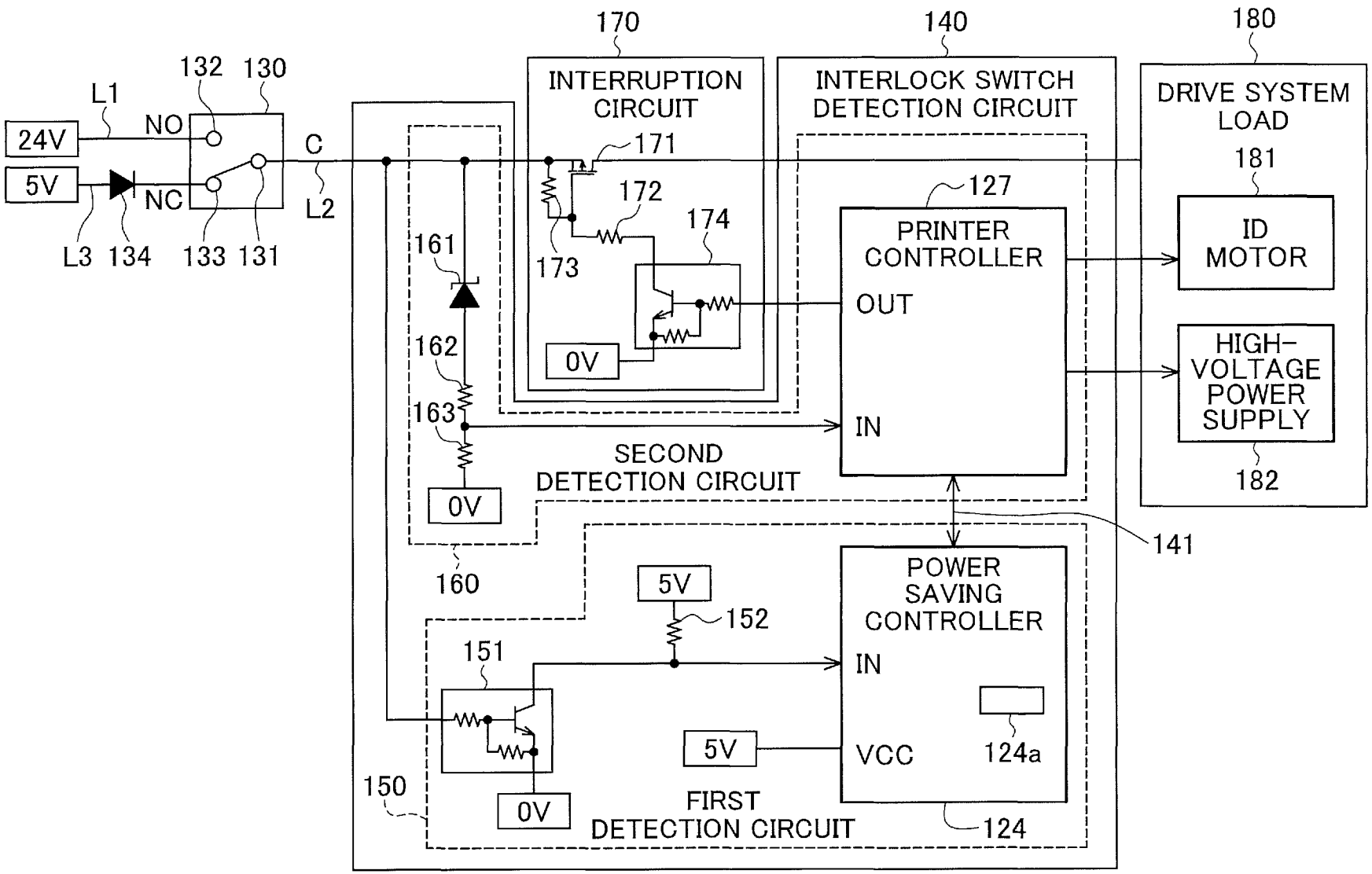
FIG. 3 is a circuit diagram of an interlock switch detection circuit provided in the image forming apparatus according to the first embodiment.

FIG. 3 is a circuit diagram of the interlock switch detection circuit 140 provided in the image forming apparatus 100 according to the first embodiment.

The interlock switch 130 is a single pole double throw switch. The interlock switch 130 includes a lever (not illustrated) that moves in accordance with opening and closing of the cover 118 of the image forming apparatus 100.

The interlock switch 130 includes a common terminal 131, a normally open (NO) terminal 132, and a normally closed (NC) terminal 133. When the cover 118 is closed, the common terminal 131 is connected to the NO terminal 132 in the interlock switch 130. When the cover 118 is open, the common terminal 131 is connected to the NC terminal 133 in the interlock switch 130.

The NO terminal 132 of the interlock switch 130 is connected to the first drive system power line L1. The first drive system power line L1 is connected to the main power supply circuit 123 and applied with the drive system supply voltage (24 V) by the main power supply circuit 123.

The NC terminal 133 of the interlock switch 130 is connected to the control system power line L3. The control system power line L3 is connected to the sub power supply circuit 121 via a backflow prevention diode 134 and applied with the control system supply voltage (5 V) by the sub power supply circuit 121. Thereby, the NC terminal 133 receives the control system supply voltage (5 V).

The common terminal 131 of the interlock switch 130 is connected to a second drive system power line L2. The second drive system power line L2 is connected to the interlock switch detection circuit 140, an interruption circuit 170, and a drive system load 180 that is a part of the image forming portion 100*a*, and is a line for supplying the drive system supply voltage (24 V) to the drive system load 180.

The NO terminal 132 is also referred to as a first terminal, the NC terminal 133 is also referred to as a second terminal, and the common terminal 131 is also referred to as a third terminal.

The interlock switch detection circuit 140 includes a first detection circuit 150 and the second detection circuit 160.

The first detection circuit 150 includes a digital transistor 151, a pull-up resistor 152, and the power saving controller 124.

The second detection circuit 160 includes a Zener diode 161, voltage dividing resistors 162 and 163, and the printer controller 127.

A base, which is an input, of the digital transistor 151 is connected to the common terminal 131 of the interlock switch 130.

A collector, which is an output, of the digital transistor 151 is connected to one end of the pull-up resistor 152 and an input terminal of the power saving controller 124, which is a first controller.

The other end of the pull-up resistor 152 is connected to the sub power supply circuit 121. The pull-up resistor 152 is a resistor for pull-up.

When the image forming apparatus 100 is in the operating mode of the power-on state, since the relay circuit 122 illustrated in FIG. 2 is closed, the drive system supply voltage (24 V) is supplied to the interlock switch 130. Thus, when the cover 118 is closed, the drive system supply voltage (24 V) is supplied to the base of the digital transistor 151, and when the cover 118 is open, the control system supply voltage (5 V) is supplied to the base of the digital transistor 151. Thus, whether the cover 118 is open or closed, a signal input to the input terminal of the power saving controller 124 is at a low level.

When the image forming apparatus 100 is in the power saving mode of the power-on state or when the image forming apparatus 100 is in the power-off state, since the relay circuit 122 illustrated in FIG. 2 is open, the drive system supply voltage (24 V) is not supplied to the interlock switch 130. Thus, when the cover 118 is closed, the drive system supply voltage (24 V) is not supplied to the base of the digital transistor 151. On the other hand, when the cover 118 is open, the control system supply voltage (5 V) is supplied to the base of the digital transistor 151. Thus, when the cover 118 is closed, the control system supply voltage (5 V) is input to the input terminal of the power saving controller 124 via the pull-up resistor 152, and thus the signal input to the input terminal of the power saving controller 124 is at a high level. On the other hand, when the cover 118 is open, the signal input to the input terminal of the power saving controller 124 is at the low level.

Thus, when the image forming apparatus 100 is in the power saving mode of the power-on state or when the image forming apparatus 100 is in the power-off state, the power saving controller 124 can detect that the cover 118 has been opened, on the basis of a change of the signal input to the input terminal from the high level to the low level. When the image forming apparatus 100 is in the power saving mode of the power-on state or when the image forming apparatus 100 is in the power-off state, upon detecting that the cover 118 has been opened, the power saving controller 124 turns on a cover open flag stored in a memory 124*a*. By turning on the cover open flag, it is possible to store information indicating that the cover 118 has been opened.

Thus, the first detection circuit 150 functions as a cover open detector that, when the control system supply voltage (5 V) is applied to the second drive system power line L2 in the power saving mode or power-off state, detects that the cover 118 has been opened.

The Zener diode 161 of the second detection circuit 160 has a breakdown voltage of 12 V.

A cathode of the Zener diode 161 is connected to the common terminal 131 of the interlock switch 130.

The voltage dividing resistors 162 and 163 are resistors that divide a voltage dropped by the Zener diode 161. A signal obtained by the voltage division by the voltage dividing resistors 162 and 163 is input to an input terminal of the printer controller 127, which is a second controller.

When the image forming apparatus 100 is in the operating mode of the power-on state, since the relay circuit 122 illustrated in FIG. 2 is closed, the drive system supply voltage (24 V) is supplied to the interlock switch 130. Thus, when the cover 118 is closed, since the drive system supply voltage (24 V) passes through the Zener diode 161, a signal input to the input terminal of the printer controller 127 is at a high level. On the other hand, when the cover 118 is open, since the control system supply voltage (5 V) is blocked by the Zener diode 161, the signal input to the input terminal of the printer controller 127 is at a low level.

When the image forming apparatus 100 is in the power saving mode of the power-on state or when the image forming apparatus 100 is in the power-off state, since the relay circuit 122 illustrated in FIG. 2 is open, the drive system supply voltage (24 V) is not supplied to the interlock switch 130. Thus, when the cover 118 is open, since the control system supply voltage (5 V) is blocked by the Zener diode 161, the signal input to the input terminal of the printer controller 127 is at the low level. Also, when the cover 118 is closed, since no voltage is applied to the second detection circuit 160, the signal input to the input terminal of the printer controller 127 is at the low level.

Thus, the printer controller 127 can determine whether the drive system supply voltage (24 V) is applied to the second drive system power line L2, on the basis of whether the signal input to the input terminal is at the high level or the low level.

Thus, the second detection circuit 160 functions as a drive system supply voltage detector that detects whether the drive system supply voltage (24 V) is applied to the second drive system power line L2.

The interruption circuit 170 includes a P-channel field effect transistor (FET) 171, a resistor 172, a resistor 173, and a digital transistor 174.

A source of the P-channel FET 171 is connected to the common terminal 131 of the interlock switch 130.

A drain of the P-channel FET 171 is connected to the drive system load 180.

A gate of the P-channel FET 171 is connected to a collector, which is an output, of the digital transistor 174 via the resistor 172.

The resistor 173 is connected in parallel between the gate and the source of the P-channel FET 171.

An output terminal of the printer controller 127 is connected to a base, which is an input, of the digital transistor 174.

The P-channel FET 171 is an interrupting element that interrupts supply of the drive system supply voltage (24 V) to the drive system load 180. By control by the printer controller 127, the P-channel FET 171 can be turned off, and supply of the drive system supply voltage (24 V) to the drive system load 180 can be stopped. Thereby, it is possible to reduce the power consumption when printing is not being performed, such as in the power saving mode.

When the printer controller 127 detects that the signal input to the input terminal is at the low level (or the drive system supply voltage (24 V) is not applied to the second drive system power line L2), it turns off the P-channel FET 171 to disconnect the drive system load 180 from the second drive system power line L2.

Thus, the interruption circuit 170 functions as an interrupter (or switch) that, when the second detection circuit 160 detects that the drive system supply voltage (24 V) is not applied to the second drive system power line L2, disconnects the drive system load 180 from the second drive system power line L2. Thereby, when the drive system supply voltage (24 V) is not applied to the second drive system power line L2, no voltage is applied to the drive system load 180 via the second drive system power line L2. This can prevent current leakage to the drive system load 180 via the second drive system power line L2. In particular, this can prevent current leakage from the sub power supply circuit 121 to the drive system load 180 when the cover 118 is open in the power-on mode.

In the power-off state, the P-channel FET 171 is off and disconnects the drive system load 180 from the second drive system power line L2. This can prevent current leakage from the sub power supply circuit 121 to the drive system load 180 when the cover 118 is open in the power-off mode.

The printer controller 127 and the power saving controller 124 are connected by a serial communication line 141, and communicate a command to change to the power saving mode, a command to return to the operating mode, a command to turn off, information indicating the state of the cover open flag, and other information.

The drive system load 180 is a load when the image forming apparatus 100 performs image formation (or printing), and includes, for example, an image drum (ID) motor 181 for providing power to parts included in the ID units 106K, 106Y, 106M, and 106C, a high-voltage power supply 182 that generates high voltages applied to the photosensitive drums 109K, 109Y, 109M, and 109C and transfer rollers 112K, 112Y, 112M, and 112C, and other components.

In FIG. 1, the dashed line indicates a state in which the cover 118 is open.

By opening the cover 118, a user can replace the ID units 106K, 106Y, 106M, and 106C, the toner cartridges 107K, 107Y, 107M, and 107C, the conveyance belt 105, or the fixing unit 113, which are consumables.

The lever of the interlock switch 130 is moved in accordance with opening and closing of the cover 118. When a user opens the cover 118, the drive system supply voltage (24 V) is disconnected, so that output of the high voltages from the high-voltage power supply 182 to the photosensitive drums 109K, 109Y, 109M, and 109C and the transfer rollers 112K, 112Y, 112M, and 112C, and rotation of the ID motor 181 that drives the ID units 106K, 106Y, 106M, and 106C are stopped. Thereby, the user can safely access the interior of the image forming apparatus 100.

While the image forming apparatus 100 is in the operating mode of the power-on state, when the printer controller 127 detects that the cover 118 has been closed, it performs, as an initial operation, a predetermined process, such as a consumable replacement check or a correction operation, such as a color registration correction.

Also, when the image forming apparatus 100 changes from the power-off state to the power-on state or when the image forming apparatus 100 returns from the power saving mode to the operating mode, the printer controller 127 performs the initial operation. However, when the cover 118 has not been opened during the power-off state or power saving mode, the initial operation may be omitted. This can eliminate the time required for the initial operation or reduce toner consumption due to the color registration correction.

Figure 4:
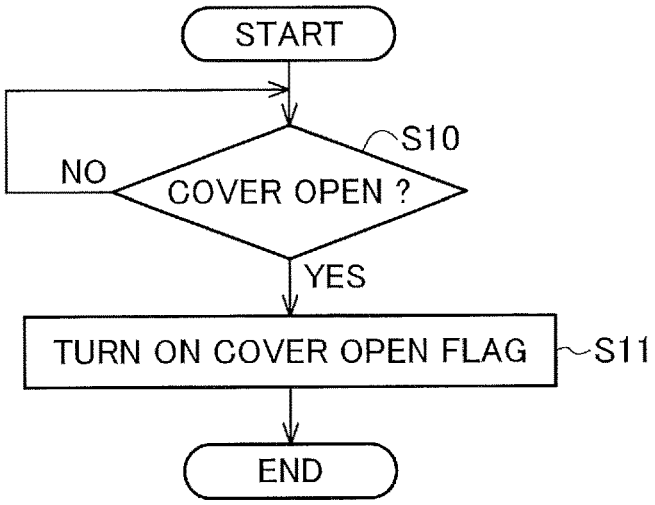
FIG. 4 is a flowchart of a cover open monitoring operation performed by a power saving controller when the image forming apparatus according to the first embodiment is in a power saving mode or a power-off state.

FIG. 4 is a flowchart of a cover open monitoring operation performed by the power saving controller 124 when the image forming apparatus 100 according to the first embodiment is in the power saving mode or power-off state. First, the power saving controller 124 reads the signal input to the input terminal and determines whether the cover 118 is open (S10). For example, the power saving controller 124 determines, when the signal is at the high level, that the cover 118 is closed, and determines, when the signal is at the low level, that the cover 118 is open. When the cover 118 is open (YES in step S10), the process proceeds to step S11.

In step S11, the power saving controller 124 turns on the cover open flag in the memory 124*a* to store information indicating that the cover 118 has been opened.

Figure 5:
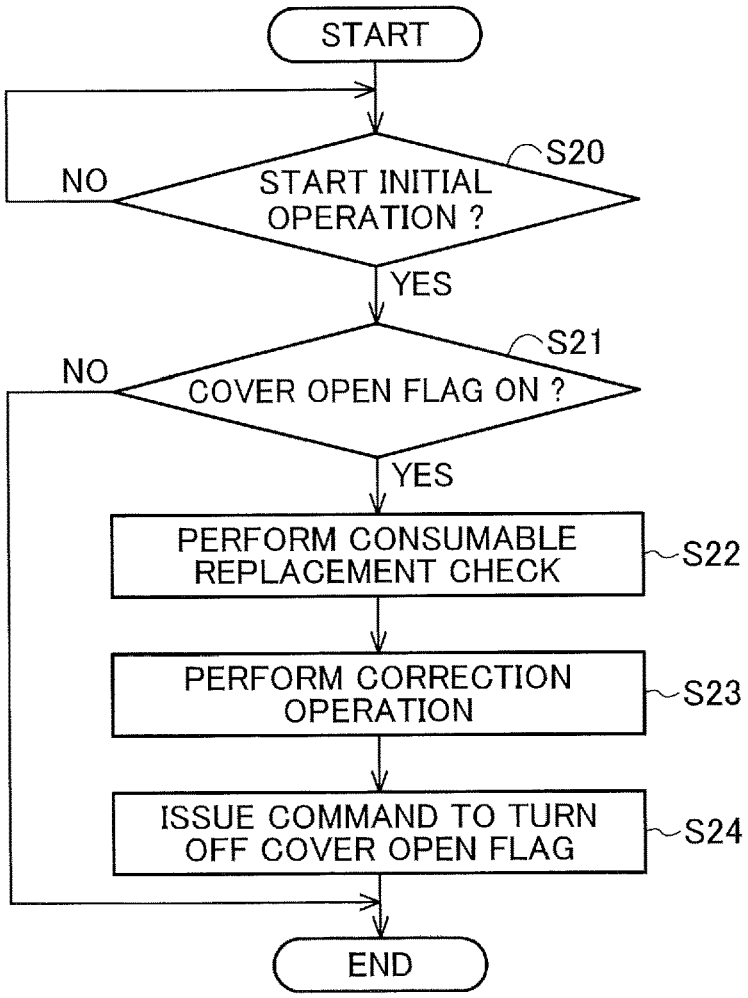
FIG. 5 is a flowchart illustrating an initial operation of a printer controller.

FIG. 5 is a flowchart illustrating an initial operation of the printer controller 127.

First, the printer controller 127 determines whether to start the initial operation (S20). For example, when the image forming apparatus 100 changes from the power-off state to the power-on state or returns from the power saving mode to the operating mode, the printer controller 127 determines to start the initial operation. When the initial operation is started (YES in step S20), the process proceeds to step S21.

In step S21, the printer controller 127 communicates with the power saving controller 124 and determines whether the cover open flag is on. When the cover open flag is on (YES in step S21), the process proceeds to step S22. When the cover open flag is off (NO in step S21), the initial operation is omitted, and the process ends. Thus, the initial operation of steps S22 and S23 is skipped.

In step S22, since the cover 118 has been opened by a user and thus there is a possibility that a consumable has been replaced, the printer controller 127 determines whether a consumable has been replaced. When a consumable has been replaced, the printer controller 127 performs a process, such as clearing a life counter, corresponding to the replaced consumable.

Then, the printer controller 127 performs a correction operation (S23). For example, the printer controller 127 performs a color registration correction to avoid color registration errors caused by slight displacements of optical axes due to handling of the ID units 106K, 106Y, 106M, and 106C by a user.

Then, the printer controller 127 communicates with the power saving controller 124 and issues a command to turn off the cover open flag (S24). Upon receiving the command, the power saving controller 124 turns off the cover open flag stored in the memory 124*a*.

As described above, in the first embodiment, a single pole double throw switch is used as the interlock switch 130, the drive system load 180 is connected to the common terminal 131, the main power supply circuit 123 that supplies the drive system supply voltage (24 V) is connected to the NO terminal 132, and the sub power supply circuit 121 that supplies the control system supply voltage (5 V) is connected to the NC terminal 133. Thus, in a state in which supply of the drive system supply voltage (24 V) is stopped, it is possible to prevent current leakage to the main power supply circuit 123 due to the control system supply voltage (5 V).

Also, the interruption circuit 170 for interrupting the drive system supply voltage (24 V) and control system supply voltage (5 V) is provided between the common terminal 131 of the interlock switch 130 and the drive system load 180. Thereby, it is possible to prevent current leakage to the drive system load 180 due to the control system supply voltage (5 V).

Further, in the power saving mode and power-off state, it is possible to detect opening and closing of the cover 118 with low power consumption.

Second Embodiment

In the first embodiment, when the image forming apparatus 100 is in the power saving mode or power-off state, once the cover 118 is opened, current driving the digital transistor 151 continues to flow due to the control system supply voltage (5 V). This increases power consumption.

Such increase in power consumption is prevented in a second embodiment.

As illustrated in FIG. 1, an overall configuration of an image forming apparatus 200 according to the second embodiment is the same as that of the image forming apparatus 100 according to the first embodiment.

Figure 6:
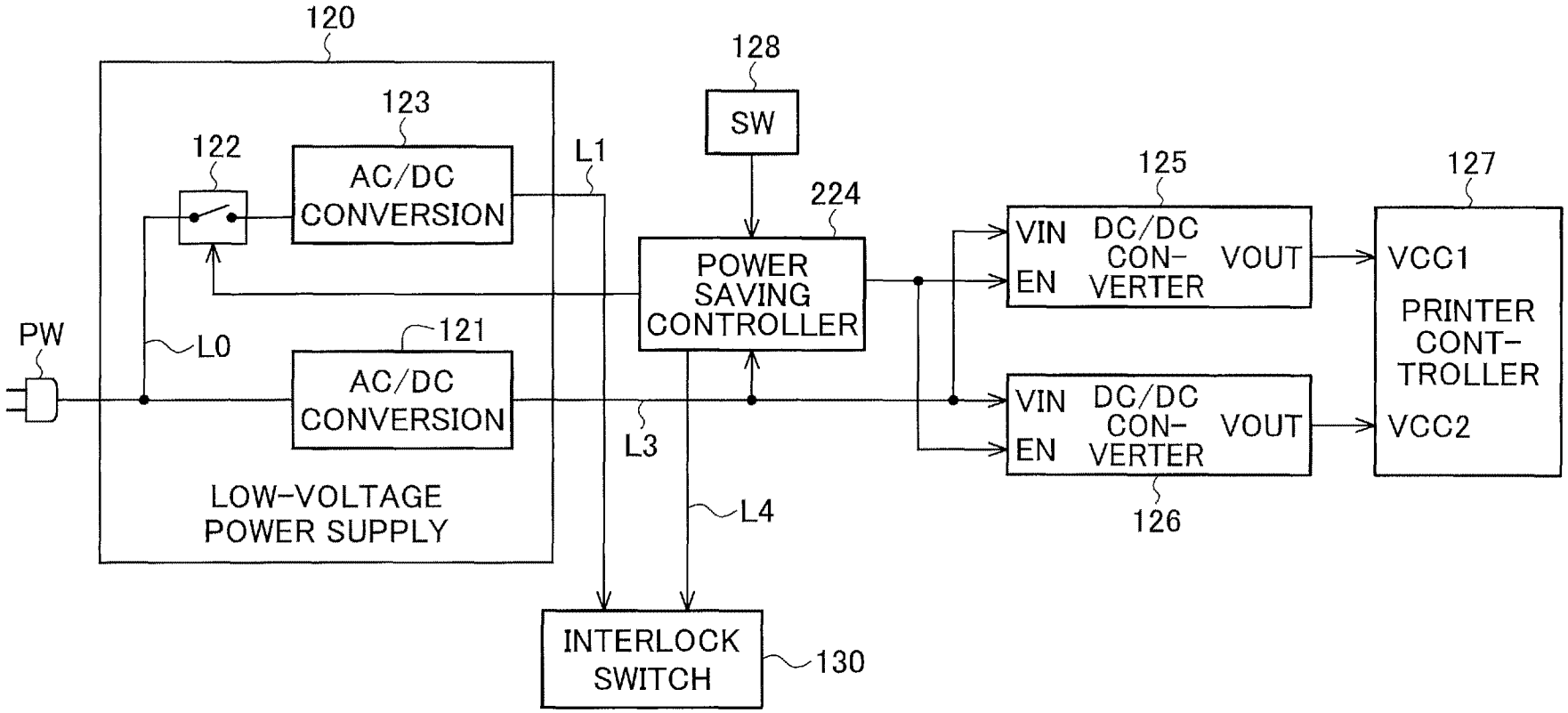
FIG. 6 is a block diagram schematically illustrating a configuration of a power supply system of an image forming apparatus according to a second embodiment.

FIG. 6 is a block diagram schematically illustrating a configuration of a power supply system of the image forming apparatus 200 according to the second embodiment.

The image forming apparatus 200 according to the second embodiment includes, as the power supply system, a low-voltage power supply 120, a power saving controller 224, a DC/DC converter 125, a DC/DC converter 126, a printer controller 127, a power switch 128, and an interlock switch 130.

The low-voltage power supply 120, DC/DC converter 125, DC/DC converter 126, printer controller 127, power switch 128, and interlock switch 130 of the power supply system of the second embodiment are the same as the low-voltage power supply 120, DC/DC converter 125, DC/DC converter 126, printer controller 127, power switch 128, and interlock switch 130 of the power supply system of the first embodiment.

In the second embodiment, the control system supply voltage (5 V) from the low-voltage power supply 120 is input to the power saving controller 224, DC/DC converter 125, and DC/DC converter 126 via a control system power line L3, and is not input to the interlock switch 130.

In the second embodiment, a signal line L4 that transmits an output signal from the power saving controller 224 is connected to the interlock switch 130.

Also in the second embodiment, the drive system supply voltage (24 V) is input to the interlock switch 130 via a first drive system power line L1.

Figure 7:
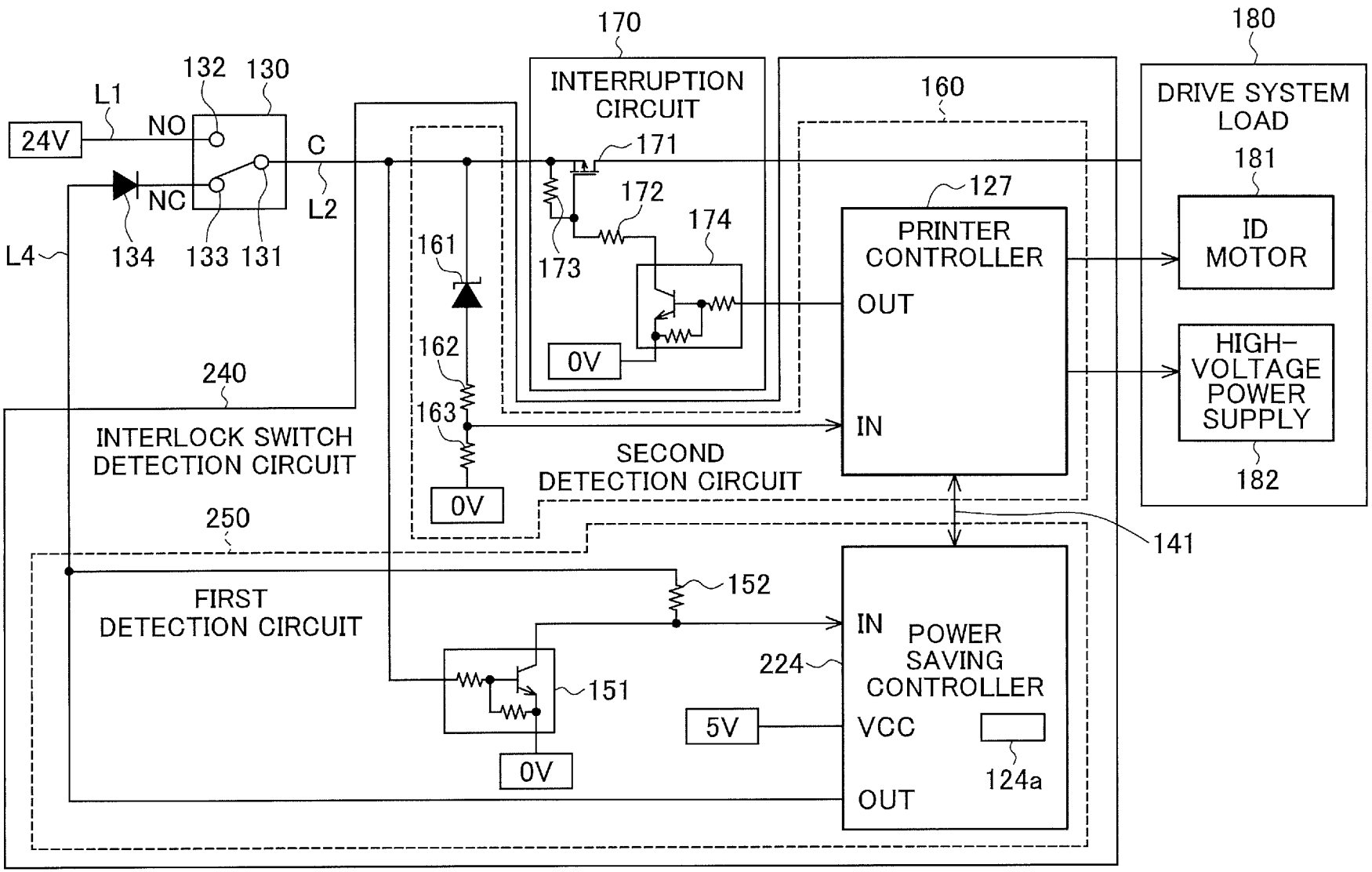
FIG. 7 is a circuit diagram of an interlock switch detection circuit provided in the image forming apparatus according to the second embodiment.

FIG. 7 is a circuit diagram of an interlock switch detection circuit 240 provided in the image forming apparatus 200 according to the second embodiment.

The interlock switch detection circuit 240 includes a first detection circuit 250, a second detection circuit 160, and an interruption circuit 170.

The second detection circuit 160 and interruption circuit 170 of the interlock switch detection circuit 240 of the second embodiment are the same as the second detection circuit 160 and interruption circuit 170 of the interlock switch detection circuit 140 of the first embodiment.

The NC terminal 133 of the interlock switch 130 is connected to the signal line L4 via a backflow prevention diode 134. The signal line L4 is connected to an output terminal of the power saving controller 224. A cover open detection signal, which is an output signal, is output from the output terminal of the power saving controller 224. When the cover open detection signal is on, the control system supply voltage (5 V) input to the power saving controller 224 is supplied to the NC terminal 133 of the interlock switch 130. Thus, the signal line L4 functions as a supply power line for supplying the control system supply voltage (5 V).

When the image forming apparatus 200 is in the power saving mode or power-off state, the power saving controller 224 sets the cover open detection signal to a high level. However, when a cover open flag stored in a memory 124*a* is turned on, the power saving controller 224 changes the cover open detection signal to a low level.

On the other hand, when the image forming apparatus 200 is in the operating mode, the power saving controller 224 sets the cover open detection signal to the low level.

The cover open detection signal is input to a pull-up resistor 152.

The state in which the cover open detection signal is at the high level is a state in which the cover open detection signal is output, and the state in which the cover open detection signal is at the low level is a state in which the cover open detection signal is not output.

When the image forming apparatus 200 is in the operating mode of the power-on state, since the cover open detection signal is at the low level, a signal input to an input terminal of the power saving controller 224 is at a low level regardless of whether the cover 118 is open or closed.

When the image forming apparatus 200 is in the power saving mode of the power-on state or when the image forming apparatus 200 is in the power-off state, since the relay circuit 122 illustrated in FIG. 6 is open, the drive system supply voltage (24 V) is not supplied to the interlock switch 130. Thus, when the cover 118 is closed, the drive system supply voltage (24 V) is not supplied to a base of a digital transistor 151. Thus, the cover open detection signal at the high level is input to the input terminal of the power saving controller 224 via the pull-up resistor 152, and the signal input to the input terminal of the power saving controller 224 is at a high level.

On the other hand, while the image forming apparatus 200 is in the power saving mode of the power-on state or while the image forming apparatus 200 is in the power-off state, when the cover 118 is opened, the cover open detection signal is supplied to the base of the digital transistor 151. Thus, when the cover 118 is open and the cover open flag is off, the signal input to the input terminal of the power saving controller 224 is at the low level. When the cover 118 is open and the cover open flag is on, since the cover open detection signal is at the low level, the signal input to the input terminal of the power saving controller 224 is at the low level.

Thus, when the image forming apparatus 200 is in the power saving mode of the power-on state or when the image forming apparatus 200 is in the power-off state, the power saving controller 224 can detect that the cover 118 has been opened, on the basis of a change of the signal input to the input terminal from the high level to the low level. When the image forming apparatus 200 is in the power saving mode of the power-on state or when the image forming apparatus 200 is in the power-off state, upon detecting that the cover 118 has been opened, the power saving controller 224 turns on the cover open flag stored in the memory 124*a*.

Thus, the first detection circuit 250 functions as a cover open detector that, when the cover open detection signal is output to a second drive system power line L2 in the power saving mode or power-off state, detects that the cover 118 has been opened, and stops output of the cover open detection signal.

FIG. 8 is a truth table of the interlock switch detection circuit 240 in the second embodiment.

In the first detection circuit 250, when the image forming apparatus 200 is in the operating mode of the power-on state and the drive system supply voltage (24 V) is supplied, the signal to the input terminal of the power saving controller 224 is at the low level regardless of whether the cover 118 is open or closed.

In the first detection circuit 250, when the image forming apparatus 200 is in the power saving mode or power-off state, the supply of the drive system supply voltage (24 V) is stopped, and the cover open detection signal is at the high level, the signal to the input terminal of the power saving controller 224 is at the low level when the cover 118 is open and at the high level when the cover 118 is closed.

In the first detection circuit 250, when the image forming apparatus 200 is in the power saving mode or power-off state, the supply of the drive system supply voltage (24 V) is stopped, and the cover open detection signal is at the low level, the signal to the input terminal of the power saving controller 224 is at the low level regardless of whether the cover 118 is open or closed.

Thus, in the interlock switch detection circuit 240 of the second embodiment, only when the image forming apparatus 200 is in the power saving mode or power-off state, the cover open detection signal is at the high level, and the cover 118 is open, power is consumed by the control system supply voltage (5 V) driving the digital transistor 151. Even in this case, upon detecting that the cover 118 has been opened, the power saving controller 224 turns on the cover open flag stored in the memory 124*a*. Thus, as soon as the cover 118 is opened, the cover open detection signal changes to the low level and the power consumption is eliminated.

Figure 9:
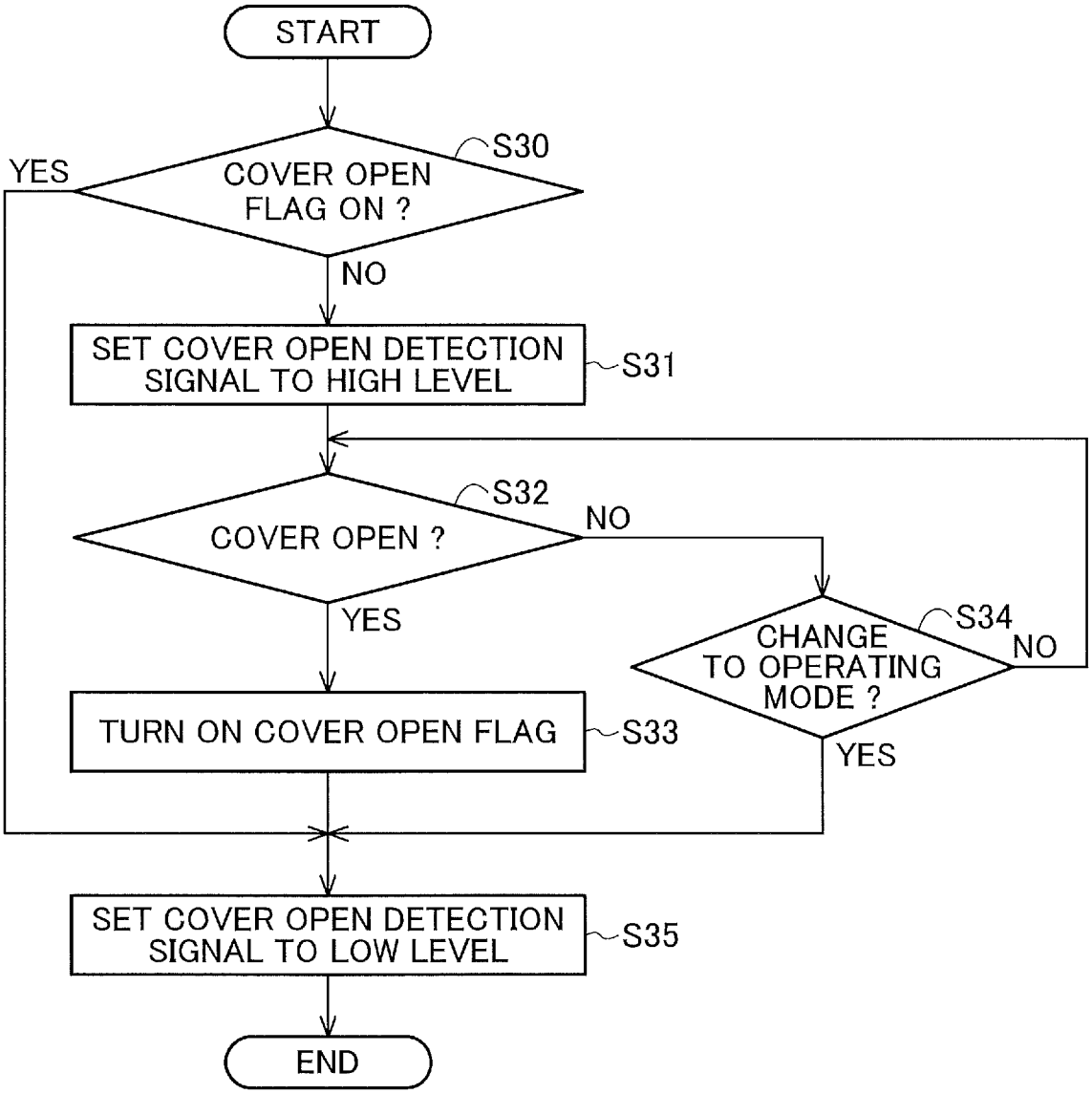
FIG. 9 is a flow chart of a cover open monitoring operation performed by a power saving controller when the image forming apparatus according to the second embodiment is in a power saving mode or a power-off state.

FIG. 9 is a flow chart of a cover open monitoring operation performed by the power saving controller 224 when the image forming apparatus 200 according to the second embodiment is in the power saving mode or power-off state.

First, the power saving controller 224 determines whether the cover open flag stored in the memory 124*a* is on (S30). When it is on (YES in step S30), the process proceeds to step S35, and when it is off (NO in step S30), the process proceeds to step S31.

In step S31, the power saving controller 224 sets the cover open detection signal to the high level.

Then, the power saving controller 224 reads the signal input to the input terminal and determines whether the cover 118 is open (S32). For example, when the signal is at the high level, the power saving controller 224 determines that the cover 118 is closed, and when the signal is at the low level, the power saving controller 224 determines that the cover 118 is open. When the cover 118 is open (YES in step S32), the process proceeds to step S33, and when the cover 118 is closed (NO in step S32), the process proceeds to step S34.

In step S33, the power saving controller 224 turns on the cover open flag stored in the memory 124*a* to store information indicating that the cover 118 has been opened, and the process proceeds to step S35.

In step S34, the power saving controller 224 determines whether a command to change to the operating mode has been issued from the printer controller 127. When the command has been issued (YES in step S34), the process proceeds to step S35; otherwise (NO in step S34), the process returns to step S32.

In step S35, the power saving controller 224 sets the cover open detection signal to the low level.

When the image forming apparatus 200 is in the operating mode, since the signal input to the input terminal of the power saving controller 224 is always at the low level, the power saving controller 224 does not detect whether the cover 118 has been opened.

As described above, in the second embodiment, a single pole double throw switch is used as the interlock switch 130, the drive system load 180 is connected to the common terminal 131, the main power supply circuit 123 that outputs the drive system supply voltage is connected to the NO terminal 132, and the output terminal of the power saving controller 224 is connected to the NC terminal 133. Thus, in a state in which supply of the drive system supply voltage (24 V) is stopped, it is possible to prevent current leakage to the main power supply circuit 123 due to the control system supply voltage (5 V).

Also, in the second embodiment, when the cover open flag is on or when the image forming apparatus 200 is in the operating mode, the cover open detection signal is set to the low level. This can reduce power consumption when the cover 118 is open.

Also, in the second embodiment, the interruption circuit 170 is provided in the power line that supplies the drive system supply voltage (24 V) to the drive system load 180. Thus, in the power saving mode, by interrupting the supply of the drive system supply voltage (24 V) and control system supply voltage (5 V) by means of the interruption circuit 170, it is possible to prevent current leakage to the drive system load 180 due to the control system supply voltage (5 V).

Also, in the second embodiment, when the image forming apparatus 200 is in the power saving mode and power-off state, it is possible to detect that the cover 118 has been opened, with low power consumption.

In the first and second embodiments, the image forming apparatuses 100 and 200 are described to be printers. However, the image forming apparatuses 100 and 200 are not limited to printers. The image forming apparatuses 100 and 200 may be other apparatuses, such as multifunction printers (MFPs), copiers, or facsimile machines, that include the interlock switch 130.

Also, regarding connection of the interlock switch 130, the main power supply circuit 123 that supplies the drive system supply voltage is connected to the NO terminal 132 of the single pole double throw switch, and the sub power supply circuit 121 that supplies the control system supply voltage is connected to the NC terminal 133. However, the first or second embodiment is not limited to such an example. When the interlock switch 130 is configured so that the lever is pushed when the cover 118 is open, the NC terminal 133 and NO terminal 132 may be respectively connected to the main power supply circuit 123 and sub power supply circuit 121.

Further, in the first (or second) embodiment, the power saving controller 124 (or 224) and the printer controller 127 are described to be different controllers. However, they may be formed by a single controller (e.g., a main controller).

Specifically, it is possible that each of the power saving controller 124 (or 224) and printer controller 127 is formed by a microcomputer, and it is also possible that the power saving controller 124 (or 224) and printer controller 127 are formed by a single microcomputer. The microcomputers are control circuits including central processing units (CPUs).

As the power saving controller 124 (or 224) and printer controller 127, control circuits other than microcomputers may be used.

What is claimed is:

1. An image forming apparatus comprising:

a housing;

an image forming portion configured to perform an operation of conveying a medium and forming a developer image on the medium, at least a part of the image forming portion being housed in the housing;

a cover attached to the housing and configured to be opened to access the part of the image forming portion;

a power supply configured to supply a drive system supply voltage used by the image forming portion and a control system supply voltage lower than the drive system supply voltage in an operating mode in which the image forming portion can perform the operation, and configured to supply the control system supply voltage without supplying the drive system supply voltage in a power saving mode in which less power is consumed than in the operating mode;

a supply power line configured to receive the control system supply voltage from the power supply;

an interlock switch including a first terminal connected to a first drive system power line to which the drive system supply voltage is applied by the power supply, a second terminal configured to receive the control system supply voltage via the supply power line, and a third terminal connected to a second drive system power line for supplying the drive system supply voltage to the image forming portion, the interlock switch being configured to connect the first terminal and the third terminal when the cover is closed, and connect the second terminal and the third terminal when the cover is open; and a cover open detector connected to the second drive system power line and configured, when the control system supply voltage is applied to the second drive system power line in the power saving mode, to store information indicating that the cover has been opened.

2. The image forming apparatus of claim 1, wherein the power supply is configured to supply the control system supply voltage without supplying the drive system supply voltage in a power-off state in which the image forming apparatus is turned off, and the cover open detector is configured, when the control system supply voltage is applied to the second drive system power line in the power-off state, to store information indicating that the cover has been opened.

3. The image forming apparatus of claim 1, wherein the supply power line is a control system power line via which the control system supply voltage is applied by the power supply.

4. The image forming apparatus of claim 1, wherein the cover open detector is configured to receive the control system supply voltage from the power supply and output the control system supply voltage as an output signal to the supply power line, and the cover open detector is configured, when the output signal is output to the second drive system power line in the power saving mode, to store information indicating that the cover has been opened, and stop the output of the output signal.

5. The image forming apparatus of claim 4, wherein the power supply is configured to supply the control system supply voltage without supplying the drive system supply voltage in a power-off state in which the image forming apparatus is turned off, and the cover open detector is configured, when the output signal is output to the second drive system power line in the power-off state, to store information indicating that the cover has been opened, and stop the output of the output signal.

6. The image forming apparatus of claim 1, further comprising:

a drive system supply voltage detector connected to the second drive system power line and configured to detect whether the drive system supply voltage is applied to the second drive system power line; and an interrupter connected to the second drive system power line and configured, when the drive system supply voltage detector detects that the drive system supply voltage is not applied to the second drive system power line, to disconnect the image forming portion from the second drive system power line.

7. An image forming apparatus comprising:

a housing;

an image forming portion configured to perform an operation of conveying a medium and forming a developer image on the medium, at least a part of the image forming portion being housed in the housing;

a cover attached to the housing and configured to be opened to access the part of the image forming portion;

a power supply configured to supply a drive system supply voltage used by the image forming portion and a control system supply voltage lower than the drive system supply voltage in an operating mode in which the image forming portion can perform the operation, and configured to supply the control system supply voltage without supplying the drive system supply voltage in a power saving mode in which less power is consumed than in the operating mode;

a supply power line configured to receive the control system supply voltage from the power supply;

an interlock switch including a first terminal connected to a first drive system power line to which the drive system supply voltage is applied by the power supply, a second terminal configured to receive the control system supply voltage via the supply power line, and a third terminal connected to a second drive system power line for supplying the drive system supply voltage to the image forming portion, the interlock switch being configured to connect the first terminal and the third terminal when the cover is closed, and connect the second terminal and the third terminal when the cover is open;

a drive system supply voltage detector connected to the second drive system power line and configured to detect whether the drive system supply voltage is applied to the second drive system power line; and an interrupter connected to the second drive system power line and configured, when the drive system supply voltage detector detects that the drive system supply voltage is not applied to the second drive system power line, to disconnect the image forming portion from the second drive system power line.

8. The image forming apparatus of claim 7, wherein the supply power line is a control system power line via which the control system supply voltage is applied by the power supply.

9. The image forming apparatus of claim 7, further comprising a cover open detector configured to receive the control system supply voltage from the power supply and output the control system supply voltage as an output signal to the supply power line.

* * * * *